United States Patent [19]

Estrella

[11] Patent Number: 4,674,603

[45] Date of Patent: Jun. 23, 1987

[54] ELEVATOR CONTROL APPARATUS

[76] Inventor: Robert Estrella, 61 Copeland St., Quincy, Mass. 02169

[21] Appl. No.: 695,464

[22] Filed: Jan. 28, 1985

[51] Int. Cl.[4] ..... B66B 1/36

[52] U.S. Cl. ..... 187/28; 187/32; 187/35; 187/95

[58] Field of Search ..... 187/32, 34, 94, 95, 187/29 R, 28, 52 LC, 29 E, 29 F, 29 P, 29 V, 35, 36; 340/21, 19 R; 414/273, 275; 104/134; 335/206, 207; 360/110

[56] References Cited

U.S. PATENT DOCUMENTS

| | | | |
|---|---|---|---|
| 2,840,188 | 6/1958 | Savage | 187/29 R |
| 2,909,129 | 10/1959 | Nichols et al. | 104/134 |
| 2,942,557 | 6/1960 | Hirsch et al. | 104/134 |
| 3,889,231 | 6/1975 | Tosato et al. | 187/29 R X |

OTHER PUBLICATIONS

Applicant's Prior Art Illustration in Figures 1–3 of Application Ser. No. 695,464 filed 1/28/85.

*Primary Examiner*—Joseph J. Rolla
*Assistant Examiner*—Edward S. Ammeen
*Attorney, Agent, or Firm*—Wolf, Greenfield & Sacks

[57] ABSTRACT

Elevator control apparatus comprising a sensing head containing a plurality of position responsive switches usable for elevator control. A tape guide is supported from the sensing head housing and includes separate guide members oppositely disposed at opposite sides of the sensing head housing along with screws for securing the oppositely disposed guide members to either side of the housing. Each guide member has a slot for receiving one side of the rigid tape.

1 Claim, 7 Drawing Figures

ELEVATOR CONTROL APPARATUS

BACKGROUND OF THE INVENTION

The present invention relates in general to elevator control apparatus and pertains, more particularly to an improved system of support for the sensing head relative to the sensing tape.

Reference is now made to the drawings herein and in particular to prior art drawings illustrated in FIGS. 1–3. FIG. 1 illustrates a landing control system associated with an elevator that is adapted to be positionable at different floors in a building. In this connection in the drawing there is shown an elevator beam 10 which has supported therefrom a number of support channels 12. Supported therefrom is a sensing head 14. FIG. 1 of the drawing also shows a control box 16 securely attached to the elevator beam 10. A two inch rolled edged steel tape 18 is attached at the top of the hoist way and is anchored, under spring tension, at the bottom of the hoist way. The top and bottom support for the steel tape is in a conventional manner. Upon the steel tape are magnetic segments that are used for elevator control.

The sensing head 14 is directly secured to the elevator such as from the channel 12A depicted in FIG. 1. At opposite ends of the sensing head 14 there are tape guides 20. It is noted particularly in FIGS. 1–3 that the tape guides extend from the end of the sensing head housing.

As noted also in FIGS. 2 and 3, the guide 20 is a one piece member that extends from the end of the head 14. In order to provide support therefor, the guide 20 is secured by means of bolts 22 to the back side 24 of the sensing head housing. A filler 26 may be employed within the housing so as to provide proper support.

The tape guide that is used in the prior art as illustrated in FIGS. 1–3 comprises a base 28 and integral side pieces 30.

As indicated previously, the use of this particular tape support is carried out by virtue of extending the single piece tape support member from an end of the sensing head extending beyond the end of the sensing head. This arrangement has been found to provide a relatively unstable support and the tape is apt to bind or become skewed in the guides. This has been found to occur primarily because these guides extend a distance beyond the end of the sensing head.

Also, for some applications it is desired that the sensing head be made and short as possible and thus this prior art arrangement which is rather an elongated sensing head is difficult to install in some installations particularly where space at the top of the elevator shaft is quite tight.

Accordingly, it is an object of the present invention to provide an improved landing control system and in particular one which is more reliable as far as support is concerned between the sensing head and the tape.

Another object of the present invention is to provide an improved elevator control apparatus in which the sensing head portion of the apparatus is more readily accessible and in which disassembly of the apparatus can be carried out more easily.

Another object of the present invention is to provide an improved elevator control system in which the support between the sensing tape and the sensing head is made more reliable and it is not apt to provide any type of binding between the support for the tape at the sensing head.

Still another object of the present invention is to provide an improved elevator control system in which the sensing head is secured together by simplified means preferably thumb screws for easy removal and repair.

SUMMARY OF THE INVENTION

To accomplish the foregoing and other objects, features and advantages of the invention there is provided an improved system for elevator control and one in particular concerned with improved support between the sensing head and the sensing tape. The sensing head is typically secured to the elevator and tracks on a steel ribbon running vertically in the elevator shaft. The sensing head passes over magnetic tape attached to the steel tape at landing sites. There are usually multiple controls provided for slowing and centering the elevator all having to do with switches mounted in the sensing head and responsive to the magnetic tape strips appearing on the steel tape. To provide for improved support between the steel tape and the sensing head, tape guides are provided one at each end of the housing with each tape guide at each end being of two piece construction and preferably not extending beyond the end of the sensing head housing. Each of the tape guides as mentioned is a two piece construction including oppositely disposed guide members one on either side of the sensing head housing rather than on the rear of the housing as in the prior art arrangement. Each of the guide members is slotted so as to receive the sensing tape. Preferably thumb screws are employed for securing the separately disposed guide members for easy removal thereof. These thumb screws also serve the dual purpose function of securing housing halfs comprising the sensing head housing together.

BRIEF DESCRIPTION OF THE DRAWINGS

Numerous other objects, features and advantages of the invention should now become apparent upon a reading of the following detailed description taken in conjunction with the accompanying drawings, in which:

FIG. 5 is a cross-sectional view taken along line 5—5 of FIG. 4;

FIG. 6 is a further cross-sectional view taken along line 6—6 of FIG. 5; and FIG. 7 is a cross-sectional view taken along line 7—7 of FIG. 5.

DETAILED DESCRIPTION

Figure 1:
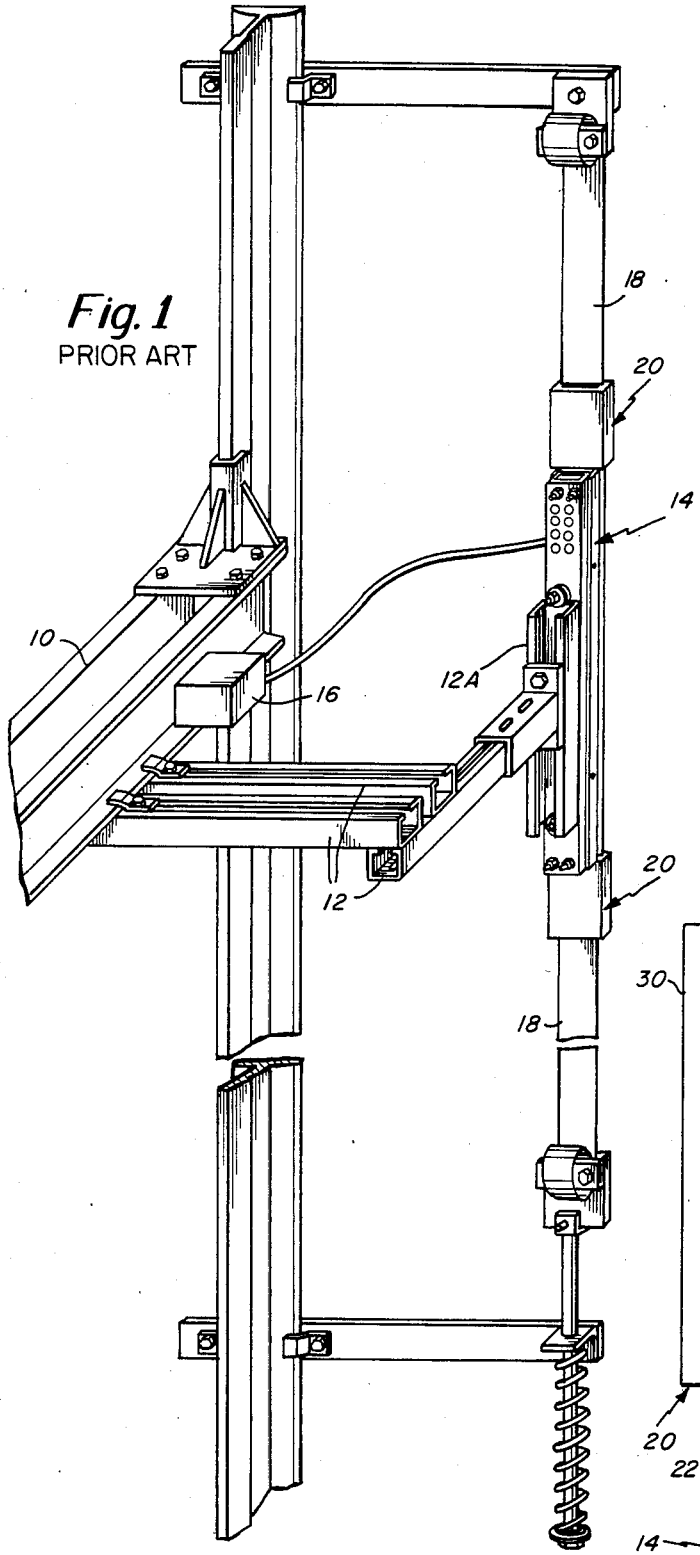
Fig. 1 PRIOR ART
FIG. 1 is a perspective view of a prior art landing control system using end extending tape guides.
Figure 2:
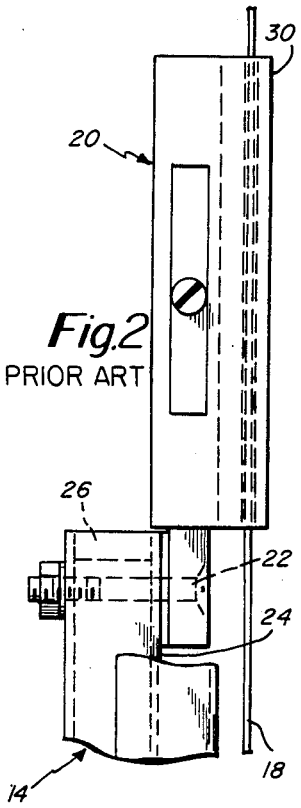
Fig.2 PRIOR ART
FIG. 2 is a prior art side view showing the manner in which the tape guides are each supported from an end of the sensing head housing.
Figure 3:
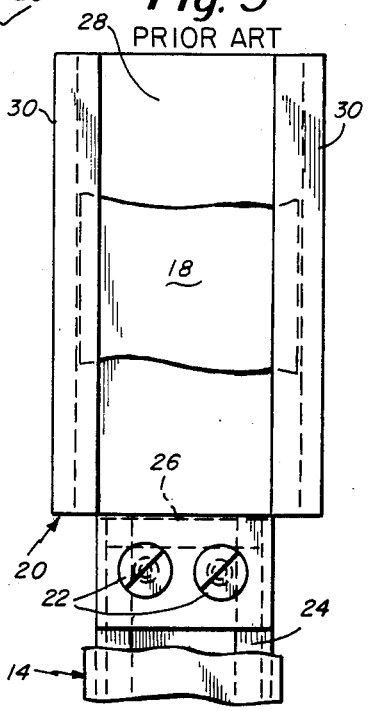
Fig. 3 PRIOR ART
FIG. 3 is a rear view showing the prior art tape guide secured from an end of the sensing head housing.
Figure 4:
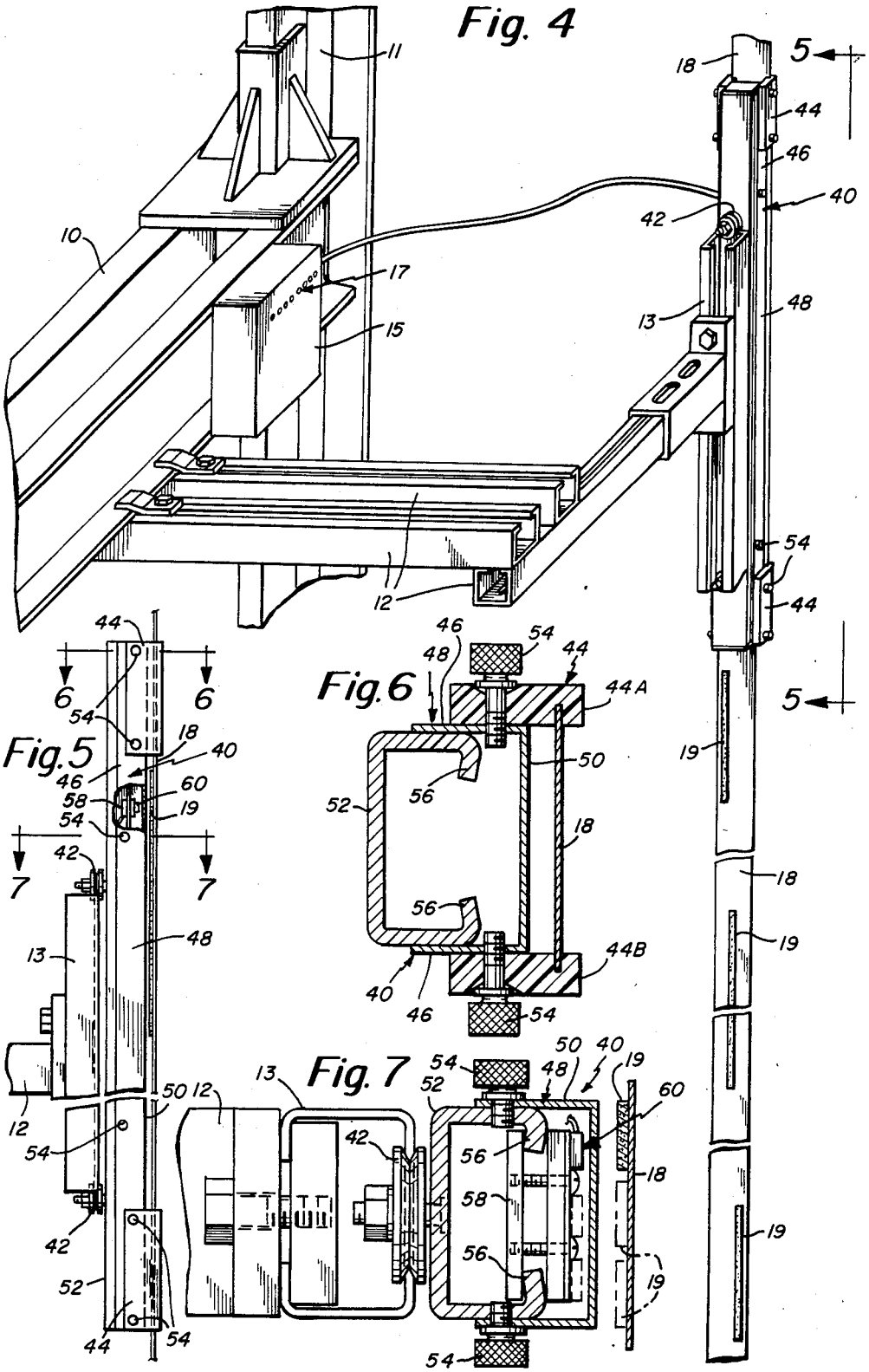
FIG. 4 is a perspective view of a landing control system embodying the improved tape guides of the present invention.

FIGS. 4–7 show the details of the improved support of the present invention for the sensing tape and the sensing head. This involves the use of improved sensing tape guides to be described in further detail hereinafter. In FIGS. 4–7 the same reference characters are used where similar parts of the apparatus are the same as in the prior art. Thus, as illustrated in FIG. 4 there is shown the elevator beam 10 that is adapted to move vertically on the support rail 11. The support rail 11 extends from top to bottom in the elevator shaft. There are a number of support channels 12 extending from the elevator beam 10 including a support channel 13 such as illustrated in FIG. 5. The sensing head 40 in accordance with the present invention is secured from the channel 13 by means of roller support such as by the rollers 42 illustrated in FIG. 5. These rollers permit a limited amount of side play so that the tape can be properly followed. In this connection the two inch rolled edge steel tape 18 having magnetic tape strips 19 secured thereto is mounted at the top of the hoist way and is anchored, under spring tension, at the bottom of the hoist way as indicated in FIG. 4. The sensing head is essentially assembled between the nylon guides 44. As the elevator moves, the sensing head 40 of course moves with it and the guides 44 travel up and down the hoist way straddling the steel tape. The sensing head monitors and is activated by magnetic strips 19. These magnetic strips are strategically located on the tape to initiate deceleration, leveling and stopping, for each floor, in response to commands issued by the car control and selector panel not illustrated in detail herein.

The tape guides 44, such as illustrated in FIGS. 4–6 comprise two separate tape guide members 44A and 44B. Each of these members are attached to the side 46 of the sensing head housing 48. Each of the members 44A and 44B is provided with an elongated slot for receiving the tape 18 as noted in FIG. 6. As also noted in FIG. 5, the members 44A and 44B are supported within the housing 48 and do not extend thereabove or therebelow in the view of FIG. 5. In this way there is thus no cantilever action by virtue of extending a guide above the housing. Also, the securing of the guides is more reliable by virtue of having separate guide members each secured to a side of the housing rather than you using a single piece guide secured to the back of the housing as in the prior art.

The sensing housing 48 is a two piece housing including elongated channel members 50 and 52. In this regard note the cross-sectional view of FIG. 6 which shows the channel members 50 and 52 interlocked forming a housing with the guide members 44A and 44B on the outside thereof. The entire assembly including the guide members and the housing members are secured together preferably by thumb screws 54. It is noted that the guide members 44A and 44B are provided with partially tapered holes for accommodating the thumb screws so as to aid in the centering thereof.

FIG. 7 is a cross-sectional view taken along line 7—7 of FIG. 5 and shows the means by which the switches are supported within the sensing head housing. It is noted that one of the housing pieces, the inner one 52 has flanges 56 (FIG. 6) from which are mounted the switches. Refer to FIG. 7 which shows on one side of the flanges a clamp 58 and on the other side thereof a series of switches 60. The switch block and the clamp may be interlocked by means of screws so as to position switches at predetermined positions longitudinally along the length of the sensing head. The particular position of the switches and the types of switches are matters of conventional design. In this connection note in FIG. 5 one of the switches 60 and its associated clamp for retaining the switch in a particular position along the up to down length of the sensing head housing 48.

As illustrated in FIG. 4 it is noted that the magnetic strips 19 may be disposed in different channels. This is also indicated in FIG. 7 which shows the steel tape 18 having multiple magnetic strips 19 secured thereto. These magnetic strips are shown in three separate lanes or tracks corresponding with the position of three different switches therebelow. These magnetic strips are polarized tape and the switches may be HALL effect switches.

It is also noted in accordance with the invention that one additional improvement is the removal of light emitting diodes from the sensing housing thus enabling one to economize on the size of the sensing head housing. The LED's are instead disposed in the control box 15 at 17.

As indicated previously, the entire sensing head unit is attached to the elevator and tracks on the steel ribbon running vertically in the elevator shaft. As also mentioned previously, there are three lanes or tracks of switches and similarly three lanes or tracks of magnetic tape on the steel tape. Two of these lanes are used for slowing and one is used for centering. By centering, this refers to the lining up of the floor of the elevator with the building floor. With regard to the centering operation, there may be six vertically disposed switches within the housing and a system is operated to center the tape over 4 of them with one at each end just passed the end of the tape. Again, the placement of the switches and their relationship to the tape is of conventional design.

Having now described a limited number of embodiments of the present invention, it should be apparent to those skilled in the art that numerous other embodiments are contemplated as falling within the scope of the present invention as defined by the appended claims.

What is claimed is:

1. Elevator control apparatus comprising, in combination, a sensing head containing a plurality of position responsive switches usable for elevator control, said sensing head being secured to the elevator, a rigid tape extending from the top to the bottom of an elevator shaft and having disposed thereon magnetic strips adapted to interact with said switches, and tape guide means one at each end of the sensing head housing, said tape guide means each comprising separate guide members oppositely disposed at opposite sides of the sensing head housing and means for securing the oppositely disposed guide members to either side of the housing including first securing screws, each guide member having a slot means for receiving one side of the rigid tape, each of the guide members being absent any portion extending lengthwise beyond the sending head housing, said sensing head housing comprising inner and outer U-shaped channel members, means for securing the inner and outer U-shaped channel members including second securing screws, at least one of said U-shaped channel members having means for supporting the plurality of switches in fixed position within the sensing head housing each switch of said plurality of switches being positioned in relationship to a respective one of said magnetic strips disposed on the rigid tape, said outer U-shaped channel member having side legs defining at least in part the sides of the sensing head housing, said side legs having first apertures for each receiving one of said securing screws to retain the guide members to the sides of the housing, said inner U-shaped channel member also having side legs defining at least in part sides of the sensing head housing, said inner channel member side legs having second apertures for each receiving one of said second securing screws, said second securing screws being secured through both of said inner and outer channel members, in linear alignment on opposite sides of the housing, said first securing screws only securing the guide members to the outer channel member in linear alignment on opposite sides of the housing, said inner channel member having flanges on the ends of said legs, the flanges disposed substantially in facing alignment, a clamp bar on one side of the flanges extending therebetween and a switch block held by the clamp bar and on the other side of the flanges so as to position the plurality of switches in close proximity to an inner surface of a wall joining the legs of the outer channel member, said first securing screws being disposed at ends of the housing beyond the switch block, said second securing screws being disposed at a more intermediate position with respect to the disposition of the first securing screws along the housing where the switch block is disposed but out of interference therewith.

* * * * *